US007677479B2

(12) United States Patent
Kitagawa et al.

(10) Patent No.: US 7,677,479 B2
(45) Date of Patent: Mar. 16, 2010

(54) FUEL INJECTION VALVE AND MANUFACTURING METHOD THEREOF

(75) Inventors: Kazunori Kitagawa, Chiyoda-ku (JP); Kouichi Ojima, Chiyoda-ku (JP); Yoshihiko Onishi, Chiyoda-ku (JP)

(73) Assignee: Mitsubishi Electric Corporation, Tokyo (JP)

( * ) Notice: Subject to any disclaimer, the term of this patent is extended or adjusted under 35 U.S.C. 154(b) by 142 days.

(21) Appl. No.: 12/111,473

(22) Filed: Apr. 29, 2008

(65) Prior Publication Data

US 2009/0108107 A1 Apr. 30, 2009

(30) Foreign Application Priority Data

Oct. 30, 2007 (JP) ..... 2007-281695

(51) Int. Cl.
*F02M 51/06* (2006.01)

(52) U.S. Cl. ..... 239/585.5; 239/585.1; 123/472; 29/888.46

(58) Field of Classification Search ..... 239/585.1, 239/585.4, 585.5; 123/472; 29/888.46
See application file for complete search history.

(56) References Cited

U.S. PATENT DOCUMENTS

| | | | | |
|---|---|---|---|---|
| 4,030,668 | A * | 6/1977 | Kiwior | 239/585.4 |
| 5,706,787 | A * | 1/1998 | Fujikawa | 123/470 |
| 6,325,049 | B1 * | 12/2001 | Nally | 123/470 |
| 6,334,433 | B1 * | 1/2002 | Sumida et al. | 123/470 |
| 6,382,532 | B1 * | 5/2002 | French et al. | 239/585.1 |
| 6,651,628 | B2 * | 11/2003 | Nally | 123/470 |
| 6,805,103 | B1 * | 10/2004 | Sumida et al. | 123/470 |
| 6,860,008 | B2 * | 3/2005 | Bodenhausen et al. | 29/855 |
| 2003/0127545 | A1 * | 7/2003 | Bulgatz et al. | 239/585.5 |
| 2004/0056121 | A1 * | 3/2004 | Dallmeyer | 239/585.1 |
| 2005/0269431 | A1 * | 12/2005 | Cho et al. | 239/585.1 |
| 2007/0000128 | A1 * | 1/2007 | Chung et al. | 29/888.4 |

FOREIGN PATENT DOCUMENTS

| | | | |
|---|---|---|---|
| JP | 05-157023 | A | 6/1993 |
| JP | 11-062710 | A | 3/1999 |
| JP | 11-182377 | A | 7/1999 |
| JP | 11-247743 | A | 9/1999 |
| JP | 2005-233178 | A | 9/2005 |
| JP | 2007-016774 | A | 1/2007 |
| JP | 2007-247410 | A | 9/2007 |

* cited by examiner

*Primary Examiner*—Erick Solis
(74) *Attorney, Agent, or Firm*—Sughrue Mion, PLLC

(57) ABSTRACT

When a fuel injection valve is mounted on an engine, a distance between a core and an armature during non-energization of a coil can be prevented from becoming narrow. The coil is arranged inside the core, and a body is fixedly secured at its one end to an end of the core. A housing is arranged outside the coil with its one end abutting a cylinder head. A cap is arranged at the other end of the housing, and abuts at its side opposite to the housing with a fastening unit. The armature is arranged for reciprocation inside the body, and is magnetically attracted to the magnetized core. A gap is formed between the housing and the body, with the cap and the core being fixed to each other, and upon mounting the valve on the engine, the housing and the fastening unit abut the cylinder head and the cap, respectively.

7 Claims, 8 Drawing Sheets

17
2
5
16
4
15
3
18
10
13
12
13
1
9
11
11a 7b
7
7a
2
5
4
6
17
1
3
18

5a
5
4
2

FUEL INJECTION VALVE AND MANUFACTURING METHOD THEREOF

BACKGROUND OF THE INVENTION

1. Field of the Invention

The present invention relates to a fuel injection valve which includes a coil, a core having an end thereof arranged at an inner side of the coil, a body having an end thereof fixedly secured to the end of the core at an inner side of the coil, and an armature arranged at an inner side of the body, and also relates to a method for manufacturing such a fuel injection valve.

2. Description of the Related Art

In the past, there has been known a fuel injection valve which includes: a coil that is adapted to be energized to generate a magnetic field; a core that has an end arranged at an inner side of the coil and is magnetized by the magnetic field generated by the coil; a cylindrical body that is made of a magnetic material, has an end thereof fixedly attached to the end of the core at an inner side of the coil, and is arranged so as to cover an axial end portion of the coil and in abutment with a cylinder head of an engine; a housing of a cylindrical shape that is made of a magnetic material, is arranged at an outer side of the coil, and has an end portion thereof fixedly attached to the body; a cap that is made of a magnetic material, is fixedly attached to the other end of the housing, is also fixedly attached to the core so as to cover the other axial end of the coil, and is arranged in abutment with a fastening unit from a side opposite to the housing side; and an armature that is arranged at an inner side of the body so as to be movable for reciprocation, and is adapted to be magnetically attracted to the magnetized core; wherein the fuel injection valve is mounted on the engine with the body and the cap being arranged in abutment with the cylinder head and the fastening unit, respectively (see, for example, a first patent document: Japanese patent application laid-open No. 2007-16774).

In this case, however, when the fuel injection valve is mounted on the engine, the body and the cap are subjected to a compression force acting in an axial direction from the cylinder head and the fastening unit, but since the core is fixedly attached to the cap, the body and the core are caused to deform in a direction to move toward each other, whereby the distance between the armature and the core at the time of the non-energization of the coil becomes narrower than a desired distance. As a result, there has been a problem that it is impossible to obtain a desired flow rate of fuel injected from the fuel injection valve.

SUMMARY OF THE INVENTION

Accordingly, the present invention is intended to obviate the problem as referred to above, and has for its object to provide a fuel injection valve and a manufacturing method thereof in which upon mounting of the fuel injection valve on an engine, the distance between an armature and a core during the non-energization of a coil can be prevented from becoming narrower than a desired distance, thereby avoiding that a desired flow rate of injected fuel can not be obtained.

Bearing the above object in mind, in one aspect of the present invention, there is provided a fuel injection valve which includes: a coil that is adapted to be energized to generate a magnetic field; a core that has an end portion arranged at an inner side of the coil and is magnetized by the magnetic field generated by the coil; a cylindrical body made of a magnetic material that has an end portion fixedly secured the end portion of the core; a cylindrical housing made of a magnetic material that is arranged at an outer side of the coil, and has one end portion thereof adapted to cover one axial end portion of the coil and at the same time arranged in abutment with a cylinder head of an engine; a cap made of a magnetic material that is arranged at the other end portion of the housing so as to cover the other axial end of the coil, and is in abutment at a side thereof opposite to the housing with a fastening unit; and an armature that is arranged at an inner side of the body so as to be movable for reciprocation, and is adapted to be magnetically attracted to the magnetized core. A fixed connection is made either between a pair of the housing and the body, or between a pair of the cap and the core, and a first gap is formed between the other pair. When the fuel injection valve is mounted on the engine, the housing is in abutment with the cylinder head, and the fastening unit is in abutment with the cap.

In another aspect of the present invention, there is provided a method for manufacturing a fuel injection valve which includes: making a fixed connection either between a pair of the housing and the body, or between a pair of the cap and the core; and fixedly securing the core to the body after the armature is inserted into the body.

According to the fuel injection valve of the present invention, the first gap is formed either between the housing and the body or between the cap and the core, so even if the body and the cap are subjected to a compression force acting in an axial direction from the cylinder head and the fastening unit when the fuel injection valve is mounted on the engine, the body and the core are not deformed in a direction to move toward each other, whereby it is possible to prevent the distance between the armature and the core at the time of the non-energization of the coil from becoming narrower than a desired distance, thus making it possible to avoid a situation that a desired flow rate of fuel injected from the fuel injection valve can not be obtained.

In addition, according to the method for manufacturing a fuel injection valve of the present invention, no compression force is generated between the core and the body when the cap is press-fitted to the housing, so it is possible to prevent the distance between the core and the armature at the time of non-energization of the coil from becoming narrow.

The above and other objects, features and advantages of the present invention will become more readily apparent to those skilled in the art from the following detailed description of preferred embodiments of the present invention taken in conjunction with the accompanying drawings.

DESCRIPTION OF THE PREFERRED EMBODIMENTS

Figure 1:
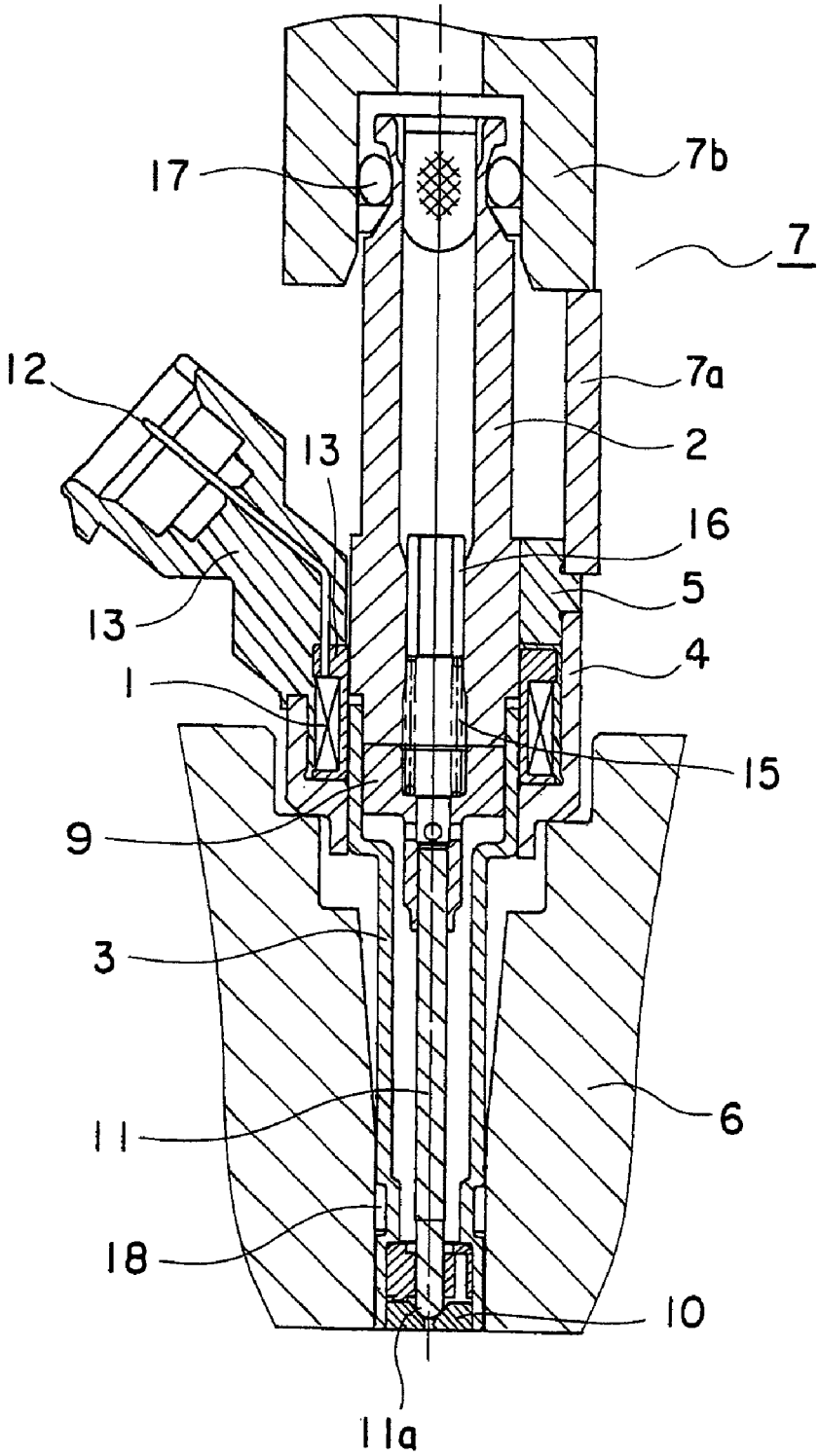
FIG. 1 is a cross sectional view showing a state that a fuel injection valve according to a first embodiment of the present invention is mounted on an engine.

Now, preferred embodiments of the present invention will be described in detail while referring to the accompanying drawings. Throughout respective figures, the same or corresponding members or parts are identified by the same reference numerals and characters.

Embodiment 1

Figure 2A:
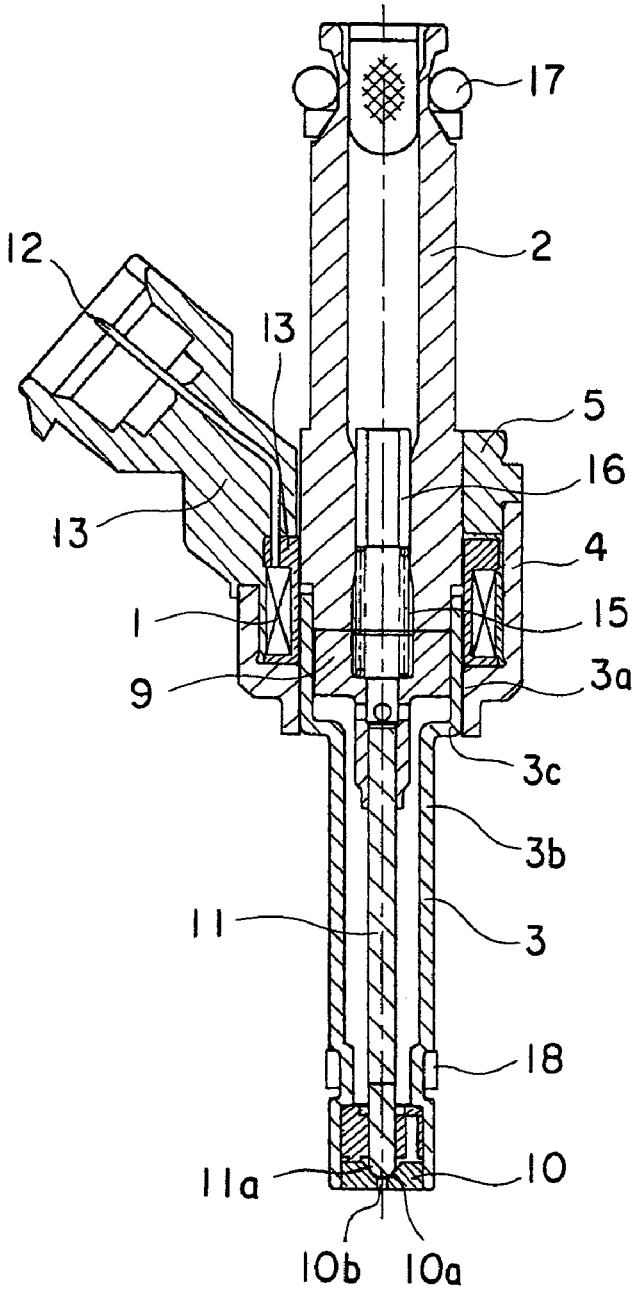
FIG. 2A is a cross sectional view of the fuel injection valve in FIG. 1.
Figure 2B:
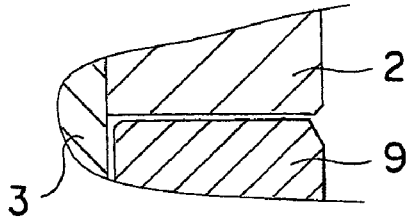
FIG. 2B is an enlarged view showing the relation between a core and an armature in FIG. 2A.
Figure 2C:
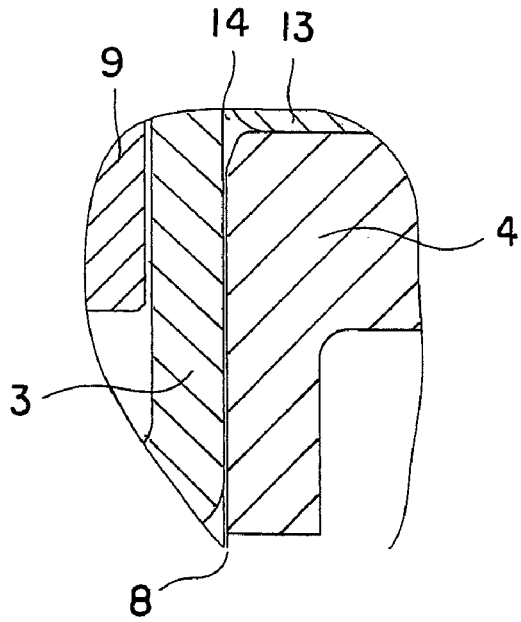
FIG. 2C is an enlarged view showing the relation between a body and a housing in FIG. 2A.

Referring to the drawings and first to FIG. 1, there is shown, in a cross sectional view, how a fuel injection valve according to a first embodiment of the present invention is mounted on an engine. FIG. 2A is a cross sectional view of the fuel injection valve in FIG. 1. FIG. 2B is an enlarged view that shows the relation between a core 2 and an armature 9 in FIG. 2A. FIG. 2C is an enlarged view that shows the relation between a body 3 and a housing 4 in FIG. 2A.

The fuel injection valve according to this embodiment includes a coil 1 that is adapted to be energized to generate a magnetic field, the core 2 of a cylindrical shape that has one end thereof arranged at an inner side of the coil 1, and the other end thereof through which fuel is supplied to flow thereinto, and the body 3 of a cylindrical shape that has one end thereof fixedly attached to the one end of the core 2, and the other end thereof from which fuel is injected.

In addition, the fuel injection valve further includes the housing 4 of a cylindrical shape that is arranged at an outer peripheral side of the coil 1 and has its one end side formed to cover one axial end portion of the coil 1, and a cap 5 that is fixedly secured to the other end side of the housing 4 and is arranged to cover the other axial end portion of the coil 1. The core 2, the body 3, the housing 4 and the cap 5 are all formed of a magnetic material.

When the fuel injection valve is mounted on the engine, the one end side of the housing 4 is placed in abutment with a cylinder head 6, and the cap 5 is placed in abutment with a fastening unit 7 from its side opposite to the housing 4.

The fastening unit 7 has a fixed portion 7*a* with which the cap 5 is in abutment, and a common rail 7*b* to which the fixed portion 7*a* is pushed and which serves to supply fuel to the core 2. Here, note that the fastening unit 7 may not has the fixed portion 7*a*, and the cap 5 may instead be placed in direct abutment with the common rail 7*b*.

A first gap 8 is formed between the body 3 and the housing 4, so that even when the housing 4 is subjected to a compression force acting thereon in an axial direction from the outside, the first gap 8 serves to prevent the compression force from being transmitted from the housing 4 to the body 3.

The armature 9, which is adapted to be attracted by the magnetized core 2, is attached to an inner side of the one end portion of the body 3 in a manner so as to be movable for reciprocation in an axial direction, and a cylindrical valve seat member 10, which has a valve seat 10*a* in the form of a conical wall and an injection hole 10*b* from which fuel is injected, is fixedly secured to the other end portion of the body 3.

A needle 11 has a basal end portion thereof fixedly attached to the armature 9, and the needle 11 is formed at its tip end portion with a seat portion 11*a* which is able to abut against the valve seat 10*a*. The injection hole 10*b* in the valve seat member 10 is closed by the abutment of the seat portion 11*a* of the needle 11 against the valve seat 10*a* of the valve seat member 10, and on the contrary, the injection hole 10*b* is opened by the movement of the seat portion 11*a* away from the valve seat 10*a*.

The body 3 has a large-diameter portion 3*a* formed at a side thereof near the core 2, a small-diameter portion 3*b* formed at a side thereof opposite to or remote from the core 2, and a stepped portion 3*c* formed between the large-diameter portion 3*a* and the small-diameter portion 3*b*.

The coil 1 can be energized through a connector 12 from the outside, and is covered with a resin 13 so as to be combined with the connector 12 to form an integral unit.

A second gap 14 is formed between the outer peripheral surfaces of the core 2 and the body 3, and the resin 13 of the coil 1 and the connector 12, so that even when a compression force acting on the housing 4 in an axial direction from the outside is transmitted to the resin 13, the second gap 14 serves to prevent the compression force from being transmitted from the resin 13 to the body 3.

The core 2 and the body 3 are adjusted in such a manner that the distance between the core 2 and the armature 9 becomes to be a desired distance when the coil 1 is in a de-energized state. As a result, when the core 2 is magnetized to attract the armature 9 under the action of a magnetic force, the distance between seat portion 11*a* and the valve seat 10*a* becomes the desired distance, whereby the flow rate of the fuel injected from the injection hole 10*b* in the valve seat member 10 can be adjusted to a desired flow rate.

A spring 15 is mounted on the armature 9 at a side thereof opposite to the needle 11, and a rod 16 is arranged at a side of the spring 15 opposite to the armature 9 and is fixedly secured to the core 2. The armature 9 is urged toward the needle 11 side by a predetermined force under the action of the resiliency of the spring 15. Here, note that the resilient force of the spring 15 applied to the armature 9 is adjusted by the position of the rod 16 mounting on the core 2.

When the coil 1 is energized by a valve opening signal from a control unit (not shown), a magnetic field is generated by the coil 1, so that a magnetic attractive force is produced between the armature 9 and the core 2. When the magnetic attractive force thus produced becomes stronger or greater than the resilient force of the spring 15, the seat portion 11*a* is caused to move away from the valve seat 10*a* by means of the magnetic attractive force, whereby fuel is injected from the injection hole 10*b* in the valve seat member 10.

On the other hand, when the coil 1 is de-energized by a valve closing signal from the unillustrated control unit, the magnetic field disappears, and the magnetic attractive force between the armature 9 and the core 2 is lost. At this time, the resilient force of the spring 15 becomes stronger or greater than the magnetic attractive force between the armature 9 and the core 2, so the seat portion 11*a* is placed into abutment with the valve seat 10*a* under the action of the resilient force of the spring 15, and the injection of fuel from the injection hole 10*b* is stopped.

A ring-shaped O ring 17 having elasticity is mounted on the outer periphery of the core 2 at a side thereof near the common rail 7*b*, and when the common rail 7*b* is mounted on the core 2, the O ring 17 serves to prevent the leakage of fuel from between the core 2 and the common rail 7*b*.

A ring-shaped side seal 18 having elasticity is mounted on the outer periphery of the body 3 at a side thereof near the cylinder head 6, and when the body 3 is mounted to the cylinder head 6, the side seal 18 serves to prevent the leakage of fuel from between the body 3 and the cylinder head 6.

Now, reference will be made to the procedure for assembling the fuel injection valve according to this embodiment.

Figure 3A:
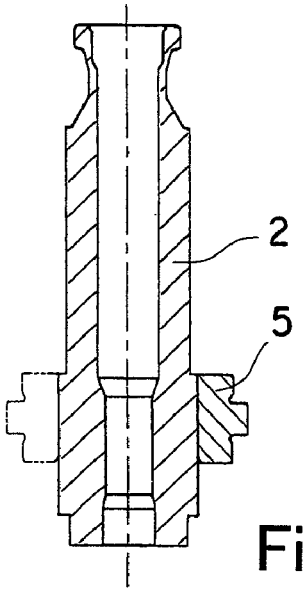
FIG. 3A is a cross sectional view showing a state that a cap is attached to the core in FIG. 1.
Figure 3C:
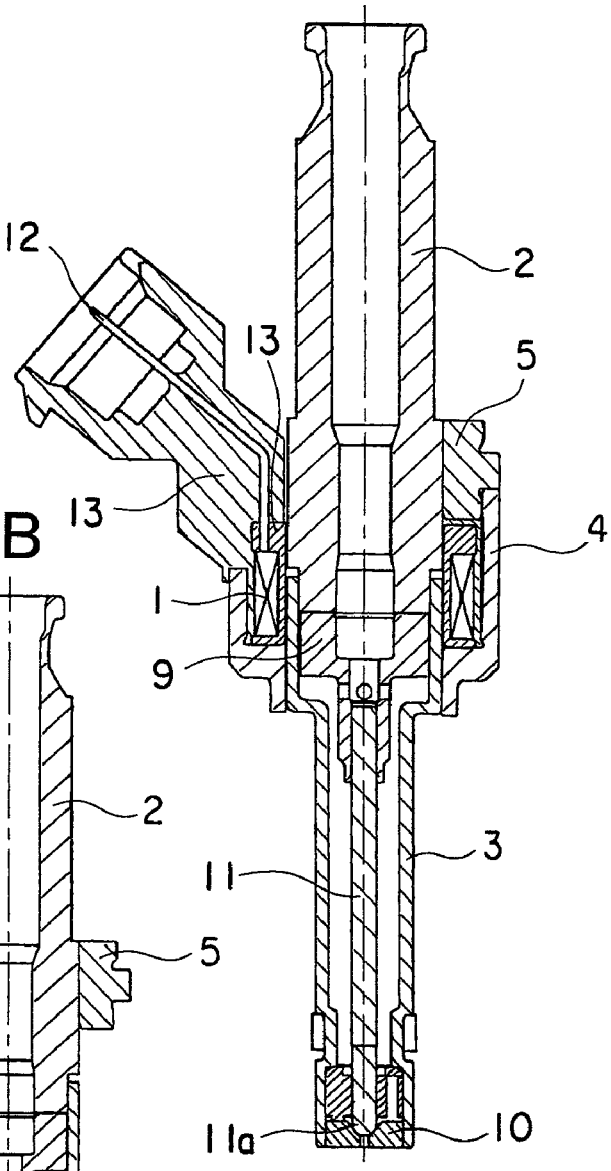
FIG. 3C is a cross sectional view showing a state that the housing is attached to the core, the cap and the body in FIG. 3B.
Figure 3B:
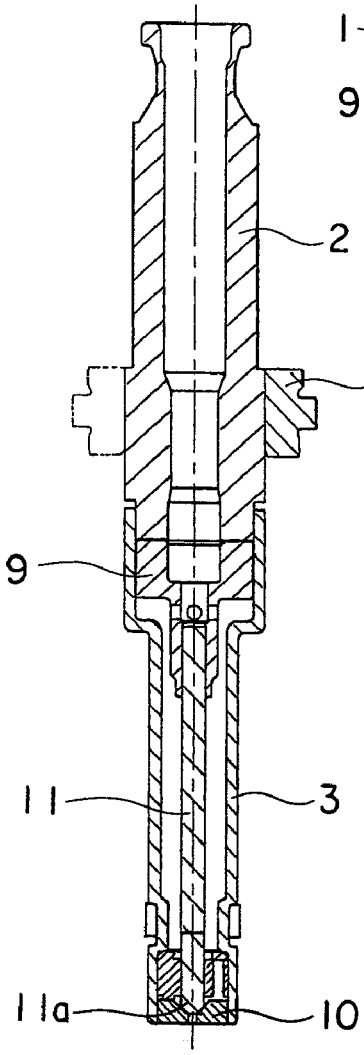
FIG. 3B is a cross sectional view showing a state that the body is attached to the core and the cap in FIG. 3A.

FIG. 3A is a cross sectional view that shows a state that the cap 5 is attached to the core 2. FIG. 3B is a cross sectional view that shows a state that the body 3 is attached to the core 2 and the cap 5 in FIG. 3A. FIG. 3C is a cross sectional view that shows a state that the housing 4 is attached to the core 2, the cap 5 and the body 3 in FIG. 3B.

First of all, the core 2 is press-fitted into the cap 5 and is fixedly secured thereto by welding, thus providing a core assembly.

Then, the valve seat member 10 is press-fitted into the body 3 and is fixedly secured thereto by welding to provide a body assembly, after which the needle 11 and the armature 9 are inserted into the body assembly.

Further, the core 2 of the core assembly is press-fitted into, and fixedly secured by welding to, the body 3 of the body assembly, and finally, the cap 5 is press-fitted into and fixedly secured by welding to the housing 4.

At this time, the first gap 8 is formed between the body 3 and the housing 4, so when the cap 5 is press-fitted into the housing 4, there is no compression force generated between the core 2 and the body 3, and it is possible to prevent the distance between the core 2 and the armature 9 at the time of the non-energization of the coil 1 from becoming narrower. Here, note that the core 2 and the cap 5 may be originally formed integrally with each other, instead of the core 2 being press-fitted into the cap 5.

Next, reference will be made to the procedure for mounting the fuel injection valve to the cylinder head 6 of the engine according to this embodiment.

The housing 4 is placed into abutment with the cylinder head 6 of the engine, and the cap 5 is also placed in abutment with the fastening unit 7, whereby the fastening unit 7 is forced to push the fuel injection valve toward the cylinder head 6 side. At this time, a compression force is generated between the cap 5 and the housing 4, thereby compressing the cap 5 and the housing 4 in an axial direction. A part of the compression force, which is received by the cap 5, is transmitted to the core 2, whereas a part of the compression force, which is received by the housing 4, is not transmitted to the body 3 because of the first gap 8 formed between the housing 4 and the body 3, so there is no compression force generated between the core 2 and the body 3.

In addition, since the second gap 14 is formed between the body 3 and the resin 13 with which the coil 1 is covered, the compression force received by the housing 4, even if transmitted to the resin 13, is not transmitted further from the resin 13 to the body 3, so there occurs no compression force between the core 2 and the body 3. Thus, the distance between the core 2 and the valve seat member 10 does not change because of the non-occurrence of a compression force between the core 2 and the body 3. Accordingly, upon mounting the fuel injection valve on the engine, it is possible to prevent the distance between the armature 9 and the core 2 at the time of the non-energization of the coil 1 from becoming narrower than the desired distance.

Now, reference will be made to the operation of the fuel injection valve according to this embodiment.

First of all, the coil 1 is energized by a valve opening signal from the control unit (not shown), and a magnetic field is generated around the coil 1. The core 2, the cap 5, the housing 4, the body 3 and the armature 9 are magnetized by the magnetic field thus generated, and a magnetic attractive force is produced between the core 2 and the armature 9.

When the magnetic attractive force becomes stronger or greater than the resilient force of the spring 15, the armature 9 is magnetically attracted to the core 2, whereby the seat portion 11*a* of the needle 11 is caused to move away from the valve seat 10*a* of the valve seat member 10, and fuel is injected from the injection hole 10*b* in the valve seat member 10. At this time, the distance for which the armature 9 moves is the desired distance between the seat portion 11*a* and the valve seat 10*a* at the time when the fuel injection valve is opened, so a desired flow rate of fuel is injected from the injection hole 10*b*.

Then, when the coil 1 is de-energized by a valve closing signal from the control unit, the magnetic field around the coil 1 disappears. Because of the disappearance of the magnetic field, the core 2, the cap 5, the housing 4, the body 3 and the armature 9 are no longer magnetized, and the magnetic attractive force between the core 2 and the armature 9 disappears. At this time, the armature 9 is caused to move in a direction away from the core 2 under the action of the resilient force of the spring 15, whereby the seat portion 11*a* is placed into abutment with the valve seat 10*a*, and the injection of fuel from the injection hole 10*b* is stopped.

As described in the foregoing, according to the fuel injection valve of this first embodiment, the core 2 and the cap 5 are fixedly connected with each other, and the first gap 8 is formed between the housing 4 and the body 3. With such an arrangement, when the body 3 is mounted to the cylinder head 6, the compression force generated between the cap 5 and the housing 4 is not transmitted between the core 2 and the body 3. As a result, it is possible to prevent the distance between the core 2 and the armature 9 at the time of the non-energization of the coil 1 from becoming narrower than the desired distance, thus making it possible to avoid a situation that the desired flow rate of fuel injected from the fuel injection valve can not be obtained.

In addition, the second gap 14 is formed between the core 2 and the resin 13 and between the body 3 and the resin 13, so the compression force generated between the cap 5 and the housing 4, even if transmitted to the resin 13, is not transmitted therefrom to the core 2 and the body 3. As a result, the distance between the core 2 and the armature 9 at the time of the non-energization of the coil 1 can be prevented from becoming narrower than the desired distance, and hence it is possible to avoid a situation that the desired flow rate of fuel injected from the fuel injection valve can not be obtained.

Moreover, the core 2 and the body 3 are fixedly connected with each other in such a manner that the distance between the core 2 and the armature 9 is adjusted to be the desired distance when the coil 1 is in the de-energized state. Accordingly, the flow rate of the fuel injected from the injection hole 10*b* in the valve seat member 10 can be adjusted to the desired flow rate.

Embodiment 2

Figure 4A:
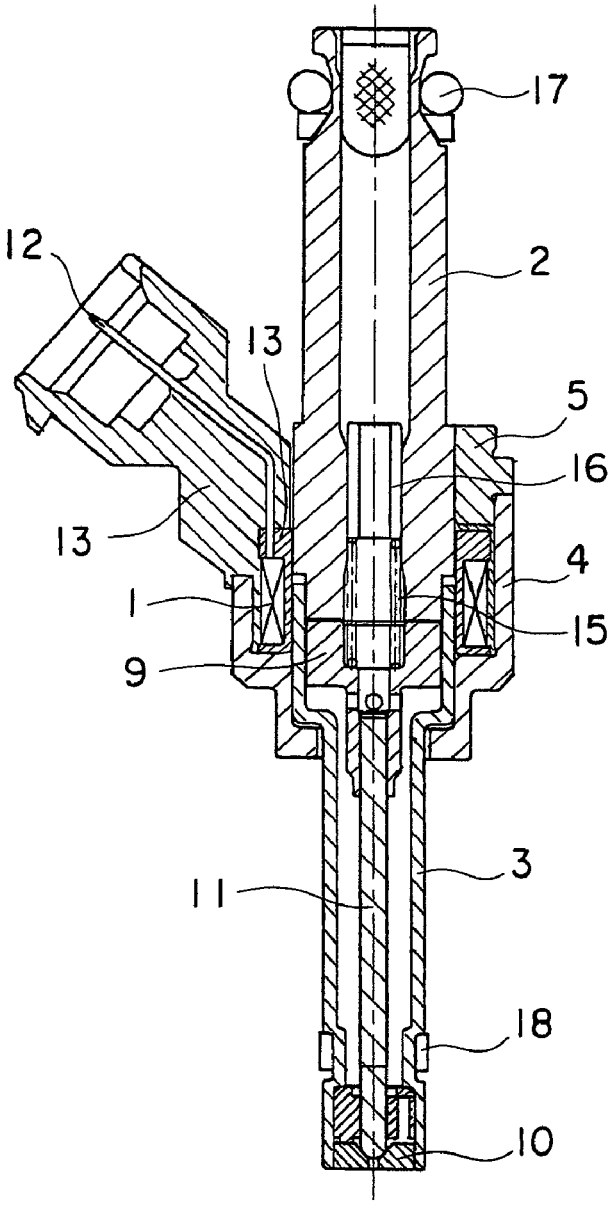
FIG. 4A is a cross sectional view showing a fuel injection valve according to a second embodiment of the present invention.
Figure 4B:
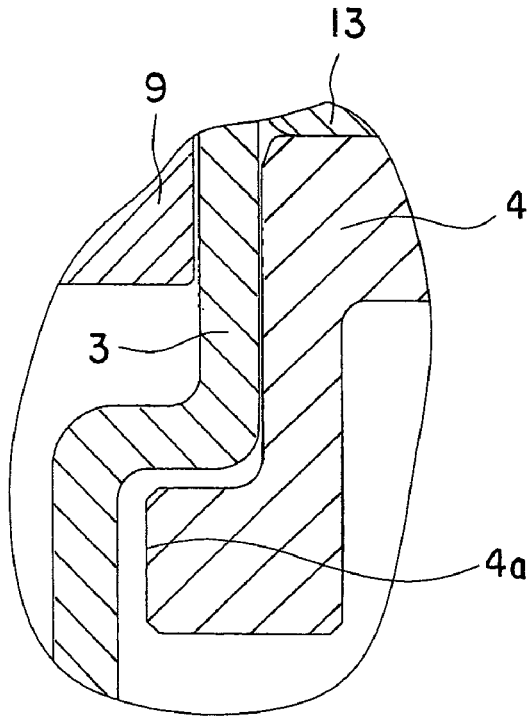
FIG. 4B is an enlarged view showing the relation between a body and a housing in FIG. 4A.

FIG. 4A is a cross sectional view that shows a fuel injection valve according to a second embodiment of the present invention. FIG. 4B is an enlarged view that shows the relation between a body 3 and a housing 4 in FIG. 4A.

In the fuel injection valve according to this second embodiment, the housing 4 is formed, at an end portion thereof abutting a cylinder head 6, with a protruded portion 4*a* that protrudes to a diametrically inner side. The protruded portion 4*a* is able to be in abutment with a stepped portion 3*c* of the body 3.

In case where the fixed connection of a core 2 and a cap 5 is released, even if the core 2 and the body 3 are subjected to a force acting thereon in a direction toward a cylinder head 6 (refer to FIG. 1) under the pressure of fuel in the interiors of the core 2 and the body 3, the protruded portion 4*a* serves to restrict the movement of the body 3 toward the cylinder head 6, so it is possible to prevent the fuel from leaking from between the core 2 and a common rail 7*b*.

The construction of this second embodiment other than the above is similar to that of the first embodiment.

As described in the foregoing, according to the fuel injection valve of this second embodiment, the protruded portion 4*a*, which is formed on the housing 4 at its end portion abutting the cylinder head 6 so as to protrude to the diametrically inner side, serves to restrict the movement of the body 3 toward the cylinder head 6 when the fixed connection between the core 2 and the cap 5 is released, whereby it is possible to prevent fuel from leaking from between the core 2 and the common rail 7*b*.

Embodiment 3

Figures 5A, 5B, 5C:
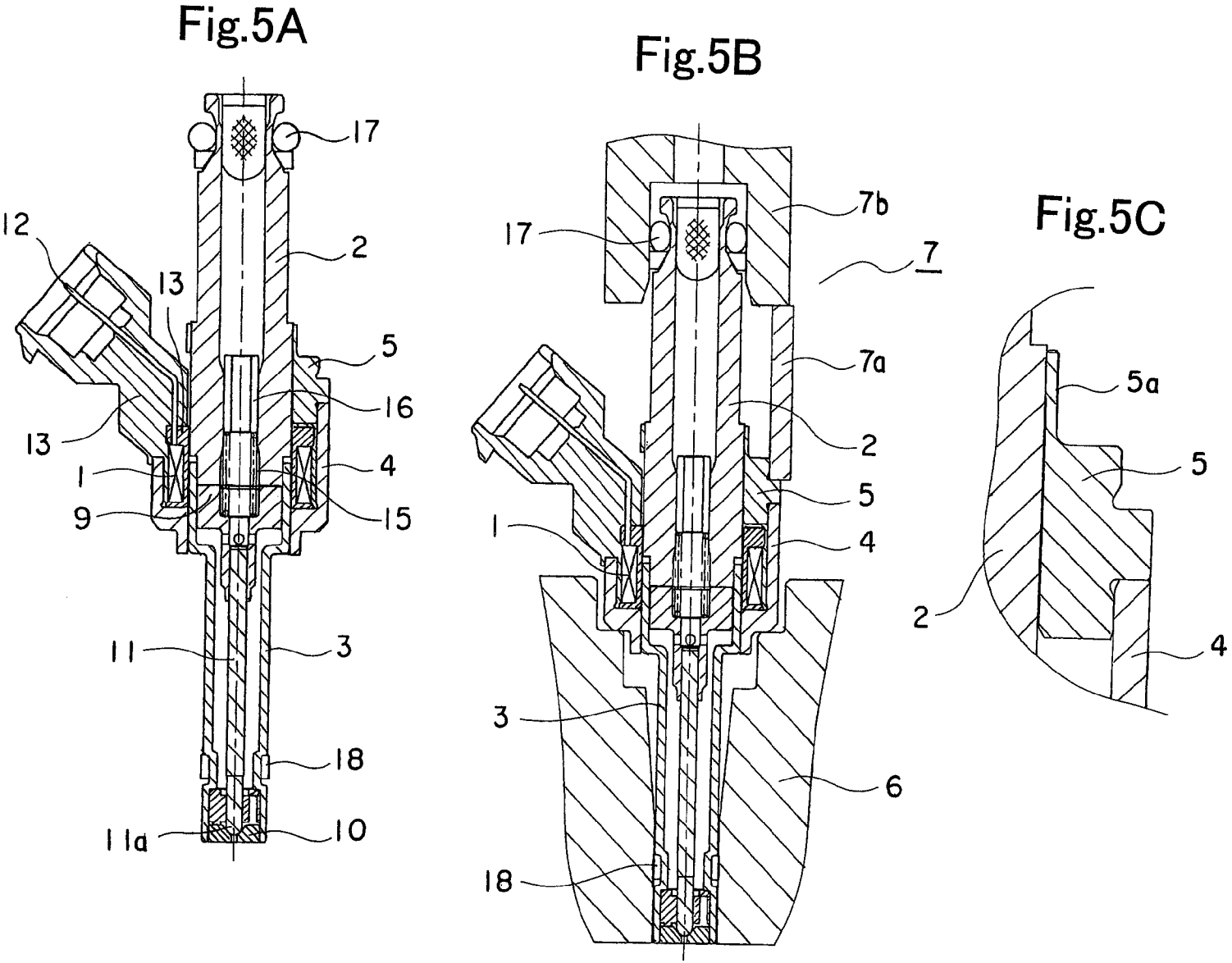
FIG. 5A is a cross sectional view showing a fuel injection valve according to a third embodiment of the present invention.
FIG. 5B is an enlarged view showing a cap in FIG. 5A.
FIG. 5C is a view showing a state that the fuel injection valve in FIG. 5A is mounted on an engine.

FIG. 5A is a cross sectional view that shows a fuel injection valve according to a third embodiment of the present invention. FIG. 5B is an enlarged view that shows a cap 5 in FIG. 5A. FIG. 5C is a view that shows a state that the fuel injection valve in FIG. 5A is mounted on an engine.

In the fuel injection valve according to this third embodiment, the cap 5 has a portion 5*a* of a thin thickness formed at an end portion thereof near a fastening unit 7.

Thus, the thin thickness portion 5*a* is able to be deformed in a diametrical direction, so when the fuel injection valve is mounted on the engine with a cylinder head 6 and a common rail 7*b* being arranged in an eccentric manner, the core 2 and the body 3 can be inclined, as a result of which a force applied to an O ring 17 and a side seal 18 can be reduced, thereby making it possible to improve sealing performance of the O ring 17 and the side seal 18.

The construction of this third embodiment other than the above is similar to that of the first embodiment.

It is to be noted that a housing 4 may be formed with a protruded portion 4*a*, as in the case of the above-mentioned fuel injection valve according to the second embodiment.

As described in the foregoing, according to the fuel injection valve of this third embodiment, the cap 5 has the thin thickness portion 5*a* formed at its end portion near the fastening unit 7, so when the fuel injection valve is mounted on the engine with the cylinder head 6 and the common rail 7*b* being arranged in the eccentric manner, the force applied to the O ring 17 and the side seal 18 can be reduced, whereby the sealing performance of the O ring 17 and the side seal 18 can be improved.

Embodiment 4

Figure 6A:
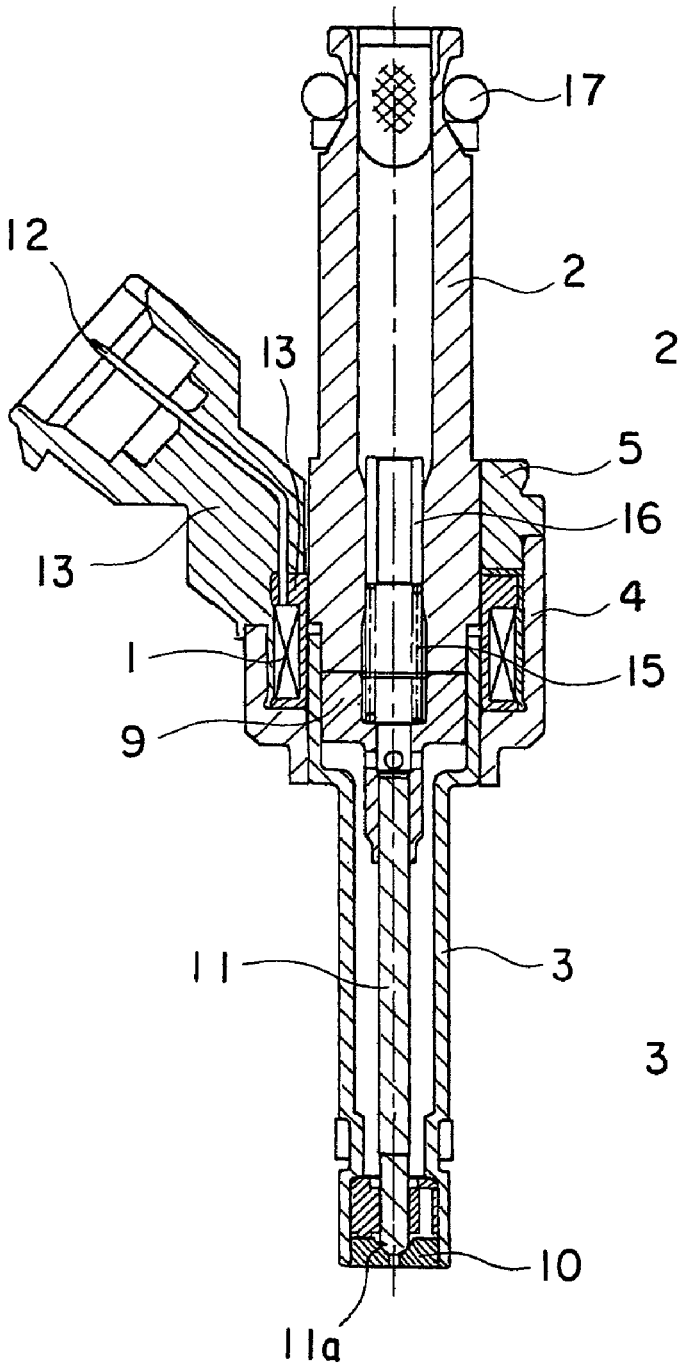
FIG. 6A is a cross sectional view showing a fuel injection valve according to a fourth embodiment of the present invention.
Figure 6B:
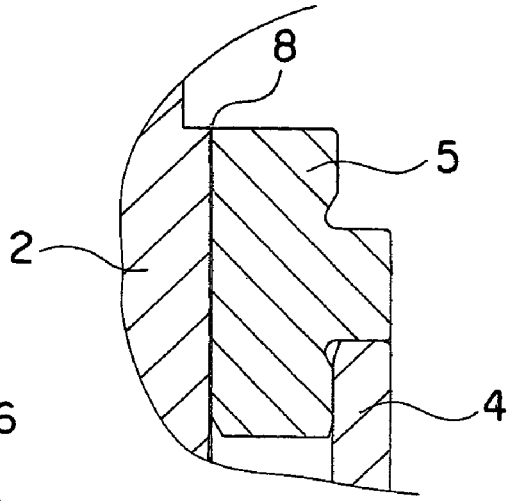
FIG. 6B is an enlarged view showing the relation between a core and a cap in FIG. 6A.
Figure 6C:
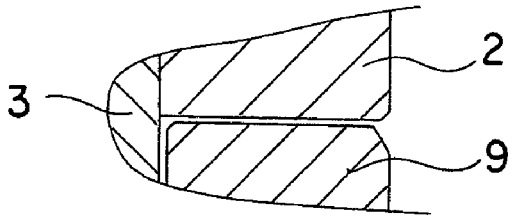
FIG. 6C is an enlarged view showing the relation between the core and a body in FIG. 6A.

FIG. 6A is a cross sectional view that shows a fuel injection valve according to a fourth embodiment of the present invention. FIG. 6B is an enlarged view that shows the relation between a core 2 and a cap 5 in FIG. 6A. FIG. 6C is an enlarged view that shows the relation between the core 2 and a body 3 in FIG. 6A.

In the fuel injection valve according to this fourth embodiment, the body 3 and a housing 4 are fixedly connected with each other. A first gap 8 is formed between the core 2 and the cap 5, and even when the cap 5 is subjected to a compression force acting thereon in an axial direction from the outside, the first gap 8 serves to prevent the compression force from being transmitted from the cap 5 to the core 2.

The construction of this fourth embodiment other than the above is similar to that of the first embodiment.

It is to be noted that the housing 4 may be formed with a protruded portion 4*a*, as in the case of the above-mentioned fuel injection valve according to the second embodiment. In addition, the cap 5 may be formed with a portion 5*a* of a thin thickness, as in the case of the above-mentioned fuel injection valve according to the third embodiment.

Now, reference will be made to the procedure for assembling the fuel injection valve according to this fourth embodiment.

Figure 7A:
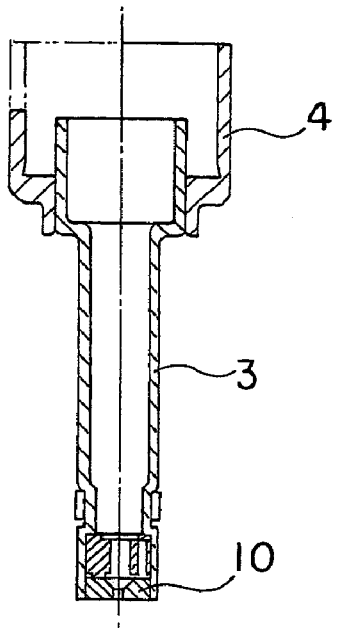
FIG. 7A is a cross sectional view showing a state that a housing is attached to the body in FIG. 6A.
Figure 7C:
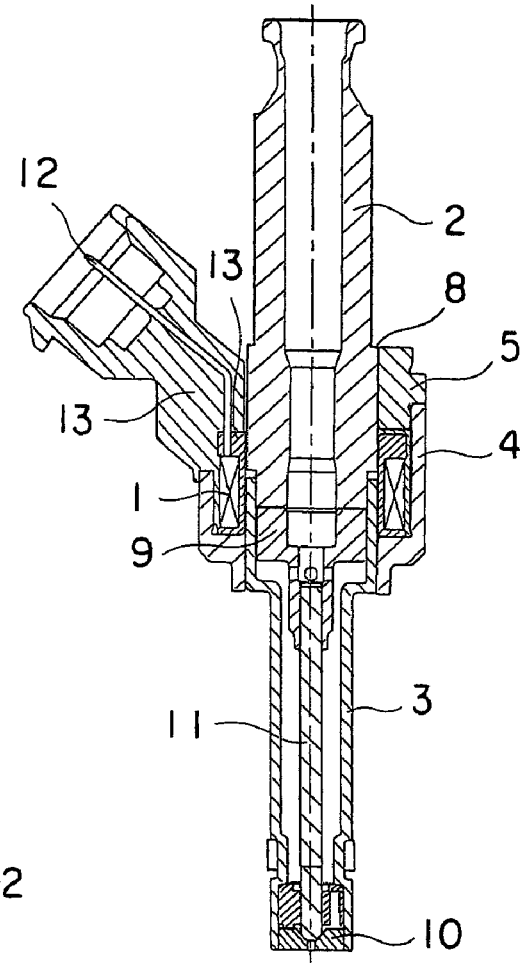
FIG. 7C is a cross sectional view showing a state that the cap is attached to the core, the body and the housing in FIG. 7B.
Figure 7B:
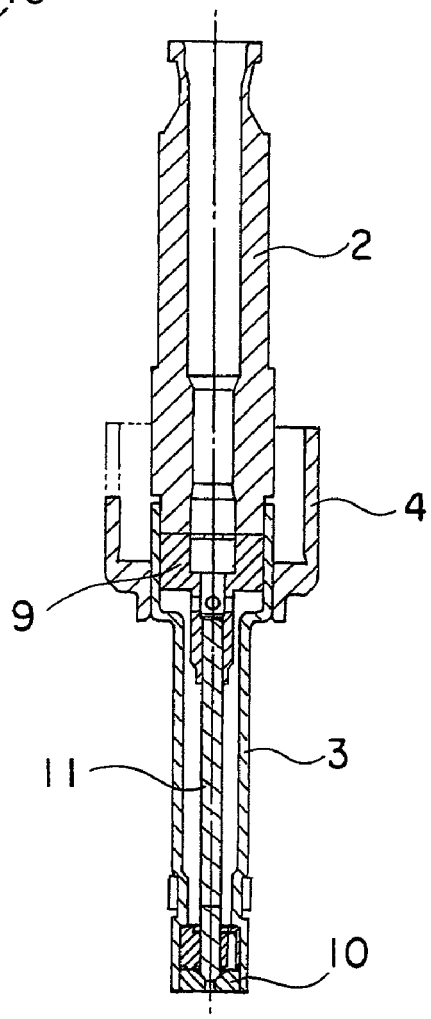
FIG. 7B is a cross sectional view showing a state that the core is attached to the body and the housing in FIG. 7A.

FIG. 7A is a cross sectional view that shows a state that the housing 4 is attached to the body 3 in FIG. 6A. FIG. 7B is a cross sectional view that shows a state that the core 2 is attached to the body 3 and the housing 4 in FIG. 7A. FIG. 7C is a cross sectional view that shows a state that the cap 5 is attached to the core 2, the body 3 and the housing 4 in FIG. 7B.

First of all, a valve seat member 10 is press-fitted into the body 3, and is fixedly secured thereto by welding to provide a body assembly. The housing 4 is press-fitted over the body 3 of this the body assembly, and is fixedly secured thereto by welding to provide a housing assembly.

Then, a needle 11 and an armature 9 are inserted into the body 3 of the housing assembly, and the core 2 is further press-fitted into the body 3, and is fixedly secured thereto by welding. Finally, the cap 5 is press-fitted into and fixedly secured by welding to the housing 4.

At this time, the first gap 8 is formed between the core 2 and the cap 5, so when the cap 5 is press-fitted into the housing 4, there is no compression force generated between the core 2 and the body 3, and it is possible to prevent the distance between the core 2 and the armature 9 at the time of the non-energization of the coil 1 from becoming narrower.

Here, note that the housing 4 may not be press-fitted to the body 3, but the housing 4 and the body 3 may instead be originally formed integrally with each other.

As described in the foregoing, according to the fuel injection valve of this fourth embodiment, the body 3 is fixedly secured to the housing 4, and the first gap 8 is formed between the core 2 and the cap 5, so when the body 3 is mounted to a cylinder head 6 (refer to FIGS. 1 and 5B), the compression force generated between the cap 5 and the housing 4 is not transmitted between the core 2 and the body 3. As a result, it is possible to prevent the distance between the core 2 and the armature 9 at the time of the non-energization of the coil 1 from becoming narrower than a desired distance, and it is possible to avoid a situation that a desired flow rate of fuel injected from the fuel injection valve can not be obtained.

Embodiment 5

Figure 8:
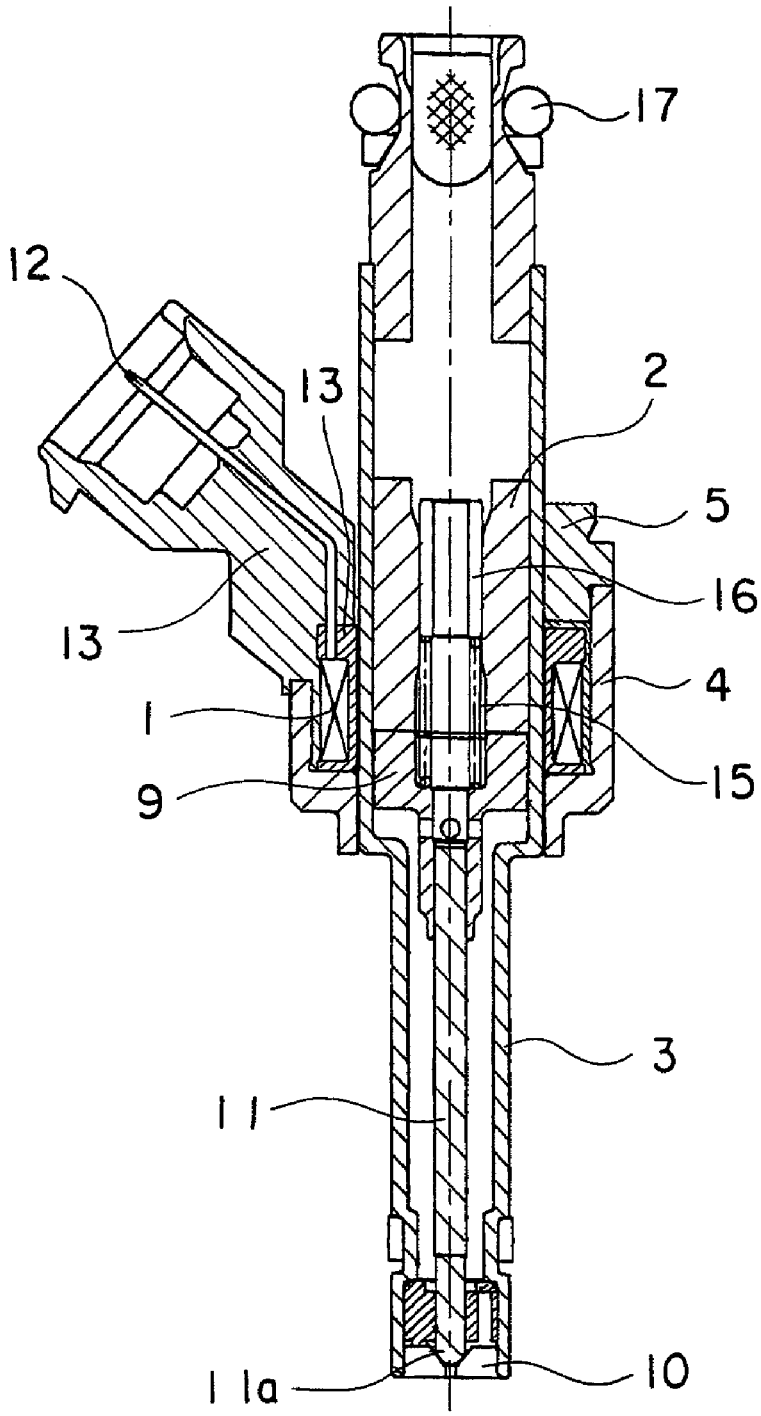
FIG. 8 is a cross sectional view showing a fuel injection valve according to a fifth embodiment of the present invention.

FIG. 8 is a cross sectional view that shows a fuel injection valve according to a fifth embodiment of the present invention.

In the fuel injection valve according to this fifth embodiment, a body 3 has an end portion at a side thereof near a core 2 formed to extend and fixedly secured to a cap 5. A first gap 8 is formed between a housing 4 and the body 3.

The construction of this fifth embodiment other than the above is similar to that of the first embodiment.

Here, it is to be noted that the housing 4 may be formed with a protruded portion 4*a*, as in the case of the above-mentioned fuel injection valve according to the second embodiment. In addition, the cap 5 may be formed with a portion 5*a* of a thin thickness, as in the case of the above-mentioned fuel injection valve according to the third embodiment.

As described in the foregoing, according to the fuel injection valve of this fifth embodiment, the body 3 and the cap 5 are fixedly connected with each other, and the first gap 8 is formed between the housing 4 and the body 3. With such an arrangement, when the body 3 is mounted to a cylinder head 6 (refer to FIGS. 1 and 5B), the compression force generated between the cap 5 and the housing 4 is not transmitted between the core 2 and the body 3. As a result, it is possible to prevent the distance between the core 2 and the armature 9 at the time of the non-energization of the coil 1 from becoming narrower than a desired distance, and it is possible to avoid a situation that a desired flow rate of fuel injected from the fuel injection valve can not be obtained.

While the invention has been described in terms of preferred embodiments, those skilled in the art will recognize that the invention can be practiced with modifications within the spirit and scope of the appended claims.

What is claimed is:

1. A fuel injection valve comprising:

a coil that is adapted to be energized to generate a magnetic field;

a core that has an end portion arranged at an inner side of said coil and is magnetized by said magnetic field generated by said coil;

a cylindrical body made of a magnetic material that has an end portion fixedly secured the end portion of said core;

a cylindrical housing made of a magnetic material that is arranged at an outer side of said coil, and has one end portion thereof adapted to cover one axial end portion of said coil and at the same time arranged in abutment with a cylinder head of an engine;

a cap made of a magnetic material that is arranged at the other end portion of said housing so as to cover the other axial end of said coil, and is in abutment at a side thereof opposite to said housing with a fastening unit; and an armature that is arranged at an inner side of said body so as to be movable for reciprocation, and is adapted to be magnetically attracted to said magnetized core;

wherein a fixed connection is made either between a pair of said housing and said body, or between a pair of said cap and said core, and a first gap is formed between the other pair; and when said fuel injection valve is mounted on said engine, said housing is in abutment with said cylinder head, and said fastening unit is in abutment with said cap.

2. The fuel injection valve as set forth in claim 1, wherein said body has an end portion extended up to between said cap and said core, and fixedly secured to said cap.

3. The fuel injection valve as set forth in claim 1, wherein said core and said body are adjusted in such a manner that a distance between said core and said armature becomes to be a desired distance when said coil is in a de-energized state.

4. The fuel injection valve as set forth in claim 1, wherein said coil is covered with a resin, and a second gap is formed between said body and said resin and between said core and said resin.

5. The fuel injection valve as set forth in claim 1, wherein said body has a large-diameter portion formed at a side thereof near said core, a small-diameter portion formed at a side thereof opposite to said core, and a stepped portion formed between said large-diameter portion and said small-diameter portion;

said housing is formed at a side thereof near said cylinder head with a protruded portion that protrudes to a diametrically inner side, and said protruded portion is adapted to be in abutment with said stepped portion thereby to restrict the movement of said body and said core toward said cylinder head.

6. The fuel injection valve as set forth in claim 1, wherein said cap is formed, at an end portion thereof near said fastening unit, with a portion of a thin thickness.

7. A method of manufacturing a fuel injection valve which is set forth in claim 1, said method comprising:

making a fixed connection either between a pair of said housing and said body, or between a pair of said cap and said core; and fixedly securing said core to said body after said armature is inserted into said body.

* * * * *